US010948192B2

(12) United States Patent
Huang et al.

(10) Patent No.: US 10,948,192 B2
(45) Date of Patent: Mar. 16, 2021

(54) GAS APPLIANCE AND CONTROL METHOD THEREOF

(71) Applicant: GRAND MATE CO., LTD., Taichung (TW)

(72) Inventors: Chung-Chin Huang, Taichung (TW); Chin-Ying Huang, Taichung (TW); Hsin-Ming Huang, Taichung (TW); Hsing-Hsiung Huang, Taichung (TW); Yen-Jen Yeh, Taichung (TW)

(73) Assignee: GRAND MATE CO., LTD., Taichung (TW)

( * ) Notice: Subject to any disclaimer, the term of this patent is extended or adjusted under 35 U.S.C. 154(b) by 111 days.

(21) Appl. No.: 16/252,105

(22) Filed: Jan. 18, 2019

(65) Prior Publication Data

US 2019/0338956 A1 Nov. 7, 2019

Related U.S. Application Data

(63) Continuation of application No. 15/970,097, filed on May 3, 2018.

(51) Int. Cl.

| | |
|---|---|
| ***F24C 3/12*** | (2006.01) |
| ***F23N 1/00*** | (2006.01) |
| ***F23N 5/10*** | (2006.01) |
| ***F23N 5/24*** | (2006.01) |

(52) U.S. Cl.

CPC ..... *F24C 3/126* (2013.01); *F23N 1/005* (2013.01); *F23N 5/105* (2013.01); *F23N 5/245* (2013.01); *F23N 2223/04* (2020.01); *F23N 2225/16* (2020.01); *F23N 2227/28* (2020.01); *F23N 2229/00* (2020.01); *F23N 2235/14* (2020.01); *F23N 2239/04* (2020.01); *F23N 2241/08* (2020.01); *F23N 2900/05005* (2013.01)

(58) Field of Classification Search

CPC ..... F24H 9/2035; F24H 1/186; F23N 5/102; F23N 5/242; F24C 3/103

See application file for complete search history.

(56) References Cited

U.S. PATENT DOCUMENTS 5,899,683 A * 5/1999 Nolte ..... F23N 5/123 431/25
6,354,830 B1 * 3/2002 de Nanclares ..... F23N 5/203 431/80

FOREIGN PATENT DOCUMENTS

JP 55151228 A * 11/1980 ..... G08B 17/06

* cited by examiner

*Primary Examiner* — Jason Lau
(74) *Attorney, Agent, or Firm* — Tracy Heims; Apex Juris, PLLC.

(57) ABSTRACT

A gas appliance includes a burner, a gas valve, an igniter, a thermocouple, and a control device. The control device is adapted to execute a control method comprising the following steps: controlling the igniter to ignite and controlling the gas valve to open; receiving a detected voltage output from the thermocouple; controlling the igniter to stop igniting and keeping the gas valve open when the detected voltage reaches a first voltage value; receiving the detected voltage output from the thermocouple continuously, and controlling the gas valve to close the gas pipe when the detected voltage above a second voltage falls below the second voltage. The second voltage value is higher than the first voltage value. As such, an ignition procedure may be speeded up and the supply of the fuel gas may be interrupted more quickly when the flame is extinguished.

11 Claims, 7 Drawing Sheets

GAS APPLIANCE AND CONTROL METHOD THEREOF

BACKGROUND OF THE INVENTION

Technical Field

The present disclosure is related to a gas appliance, and, more particularly, to a gas appliance which can detect a flame produced thereby through using a thermocouple.

Description of Related Art

Gas appliance is the common use in the heating device. Compared with the electro-thermal heating device, the gas appliance generates more heat energy by igniting the fuel gas. In addition, both the heating time and the response time of the gas appliance are less than that of the electro-thermal heating device.

Referring to FIG. 1, a gas stove 1 is taken as an example of a conventional gas appliance and includes a burner 10, a manual gas regulating valve assembly 12, an igniter 14, an ignition circuit 16, and a thermocouple 18. The burner 10 is adapted to burn the fuel gas to produce a flame. The manual gas regulating valve assembly 12 includes a valve body 122, a knob 124, and a switch 126. The valve body 122 is installed on a gas pipe p communicating with the burner 10. An electromagnetic valve (not shown) is provided in the valve body 122 to open or close the gas pipe p. The knob 124 is engaged with the valve body 122 and is operated to open the electromagnetic valve. When the knob is rotated, a mass flow of the fuel gas entering the burner 10 is regulated. When the knob 124 is turned to an ignition position, the switch 126 will be triggered. The igniter 14 is adjacent to a flame port of the burner 10 and is electronically connected to the ignition circuit 16. When the switch 126 is triggered, the ignition circuit 16 is activated and outputs a high voltage for the igniter 14 to generate a spark for igniting the fuel gas flowing out of the burner 10. The thermocouple 18 is adjacent to the burner 10, is electronically connected to the electromagnetic valve in the valve body 122, and is adapted to detect the flame to generate a detected voltage. The detected voltage is then sent to the electromagnetic valve.

When the gas stove 1 is operated, the knob 124 is pressed to open the electromagnetic valve in the valve body 122, which allows the fuel gas to flow into the burner 10, and then the knob 124 is turned to the ignition position to trigger the switch 126, which makes the igniter 14 ignite the fuel gas. Referring to FIG. 2, after the fuel gas is ignited, the detected voltage generated by the thermocouple 18 may increase gradually. When the detected voltage reaches a predetermined voltage value V, the electromagnetic valve will have a constant magnetic field to keep open for the fuel gas to pass through even if the knob 124 is not pressed then. Thus, the ignition procedure is completed.

During the ignition procedure a user needs to keep pressing the knob 124 even seeing the flame present because in order to keep the electromagnetic valve open, the thermocouple 18 needs to be heated for a far more time to reach the predetermined voltage value V. If the user stops pressing the knob 124 too early, which means that the electromagnetic valve has not had the constant magnetic field yet, then the gas pipe p will be closed instantly, which causes the ignition procedure to be failed. However, it is difficult for the user to know whether the electromagnetic valve has the constant magnetic field or not so he only can decide not to press by his experience, which results in inconvenience.

In addition, still referring to FIG. 2, when the flame is extinguished by the wind accidentally, the detected voltage generated by the thermocouple 18 will decrease gradually. When the detected voltage falls below the predetermined voltage value V, the electromagnetic valve does not have the magnetic field any longer so the gas pipe p will be closed instantly, which prevents the fuel gas from leaking out of the burner 10 continuously.

However, the decreasing rate of the detected voltage is much slower than the increasing rate thereof, which means that when the flame is extinguished accidently, it requires a longer time (i.e., more than one minute) for the detected voltage to fall below the predetermined voltage value V. In other words, it takes more than one minute for the electromagnetic valve to close the gas pipe p when the flame is extinguished accidently.

In such condition, if the flame is extinguished accidentally while the fuel gas has a large mass flow, a huge amount of the fuel gas may leak out of the burner 10 for more than one minute, which affects the safety of using the gas stove 1, and the even worse is that if there is an additional spark, it may ignite the leaking fuel gas to cause a disastrous consequence.

BRIEF SUMMARY OF THE INVENTION

In view of the above, an object of the present disclosure is to provide a gas appliance and a control method thereof that takes less time to detect whether an ignition is successful.

Another object of the present disclosure is to provide a gas appliance and a control method thereof that can interrupt the supply of a fuel gas more quickly when a flame produced by the gas appliance is extinguished accidentally, whereby improving the safety of using the gas appliance.

To achieve the objects mentioned above, the present disclosure provides a control method for a gas appliance. The gas appliance includes a burner, a gas valve, an igniter, and a thermocouple. The burner includes at least one flame port. The gas valve is installed on a gas pipe communicating with the burner, and is controlled to open or close the gas pipe. The igniter is adjacent to the flame port of the burner and is controlled to ignite a fuel gas flowing out of the flame port to produce a flame. The thermocouple is adjacent to the burner, is adapted to detect the flame, and generates a detected voltage with respect to a detection period of time. The control method comprises the steps of: A. controlling the igniter to ignite and controlling the gas valve to open; B. receiving the detected voltage generated by the thermocouple; C. controlling the igniter to stop igniting and controlling the gas valve to keep the gas pipe open when the detected voltage reaches a first voltage value; D. receiving the detected voltage from the thermocouple continuously and controlling the gas valve to close the gas pipe when the detected voltage above a second voltage value falls below the second voltage value. The second voltage value is higher than the first voltage value.

The present disclosure provides a gas appliance including a burner, a gas valve, an igniter, a thermocouple, and a control device. The burner includes at least one flame port. The gas valve is installed on a gas pipe communicating with the burner, and is controlled to open or close the gas pipe. The igniter is adjacent to the flame port of the burner and is controlled to ignite a fuel gas flowing out of the flame port. The thermocouple also adjacent to the burner is adapted to detect a flame and generates a detected voltage with respect to a detection period of time. The control device is electronically connected to the gas valve, the igniter, and the thermocouple. The control device controls the igniter to ignite and controls the gas valve to open. Then, when the detected voltage generated by the thermocouple reaches a first voltage value, the control device controls the igniter to stop igniting and keeps the gas valve open. When the detected voltage above a second voltage value falls below the second voltage value, the control device controls the gas valve to close the gas pipe. The second voltage value is higher than the first voltage value.

The advantage of the present disclosure is that through taking a detected voltage value of the detected voltage generated by the thermocouple as the first voltage value to define the successful ignition, the ignition procedure may be speeded up and the ignition time as well as the power consumption during the ignition procedure may be reduced. Taking the second voltage value that is more than the first voltage value as a basis to determine an extinguishment of the flame may stop the supply of the fuel gas quickly, which improves the safety of using the gas appliance.

BRIEF DESCRIPTION OF THE SEVERAL VIEWS OF THE DRAWINGS

The present disclosure will be best understood by referring to the following detailed description of some illustrative embodiments in conjunction with the accompanying drawings, in which.

DETAILED DESCRIPTION OF THE INVENTION

Figure 1:
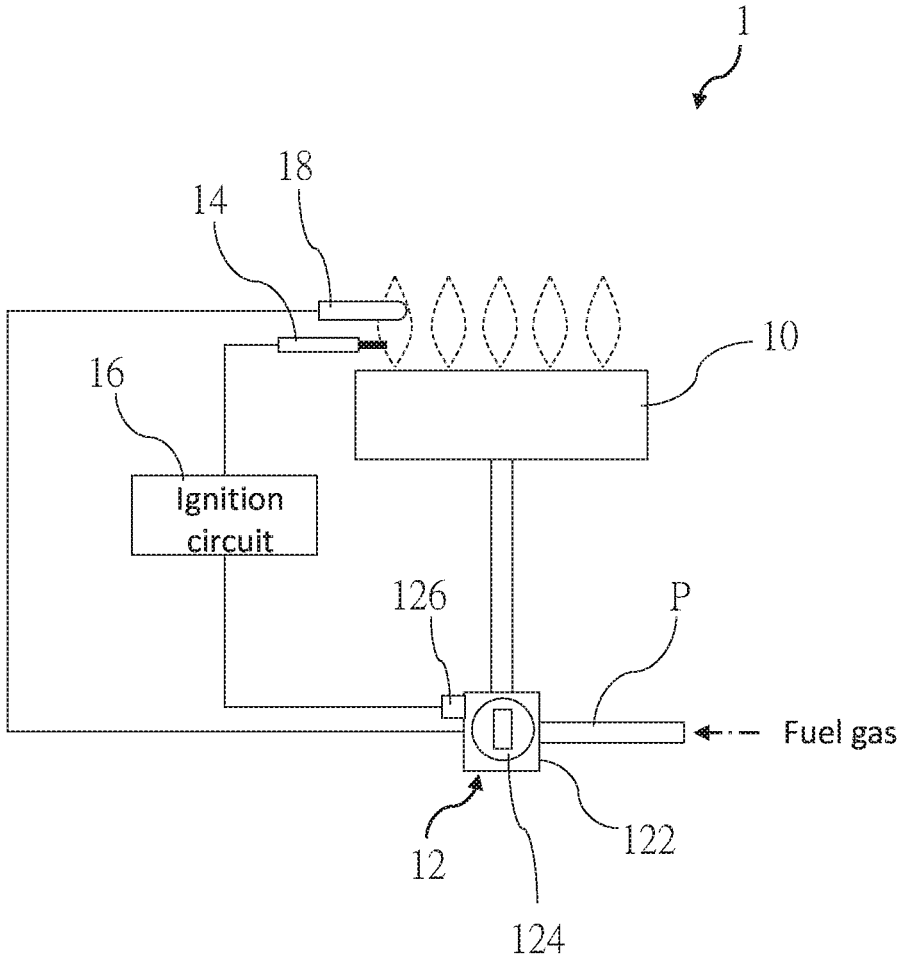
FIG. 1 (PRIOR ART)
FIG. 1 is a schematic diagram showing the conventional gas appliance.
Figure 2:
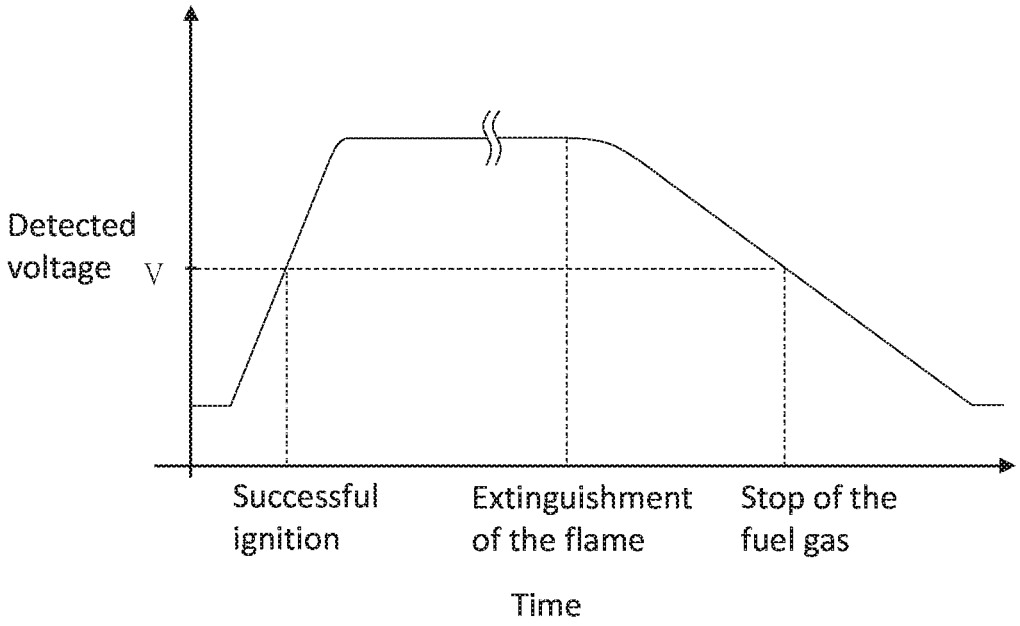
FIG. 2 (PRIOR ART)
FIG. 2 is a curve diagram showing the detected voltage generated by the thermocouple with respect to the detection period of time according to the conventional gas appliance.
Figure 3:
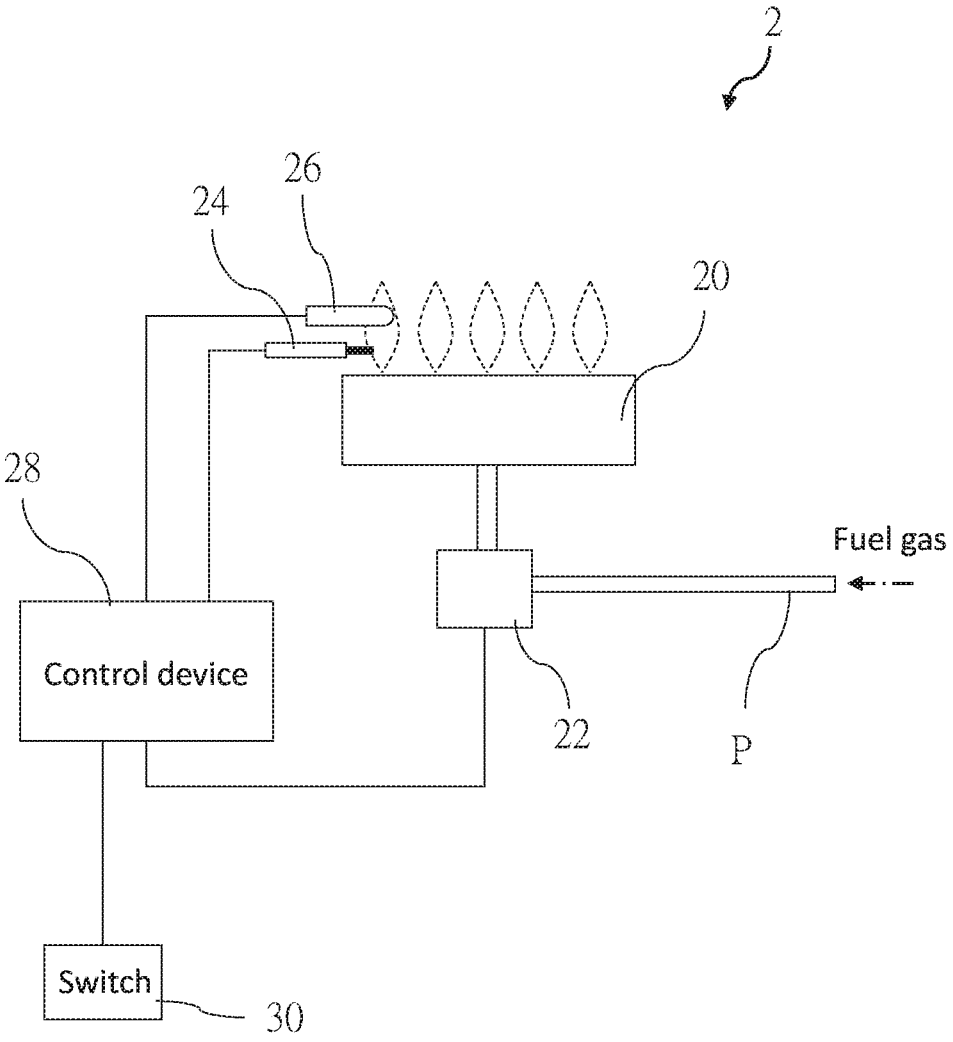
FIG. 3 is a schematic diagram showing the gas appliance according to a first embodiment of the present disclosure.

The following illustrative embodiments and drawings are provided to illustrate the disclosure of the present disclosure, these and other advantages and effects can be clearly understood by persons skilled in the art after reading the disclosure of this specification. As shown in FIG. 3, a gas appliance 2 of a first embodiment according to the present disclosure includes a burner 20, a gas valve 22, an igniter 24, a thermocouple 26, and a control device 28. In the present embodiment, the gas appliance 2 is a gas stove as an example, though it is not limited thereto. The gas appliance 2 may be a gas heating device such as a fireplace or a water heater, etc.

The burner 20 includes at least one flame port and is adapted to burn fuel gas to generate a flame. The gas valve 22 is installed on a gas pipe P communicating with the burner 20. The gas valve 22 is controlled to open or close the gas pipe P for regulating the fuel gas flowing into the burner 20. The igniter 24 is adjacent to the flame port of the burner 20 and is controlled to generate a spark to ignite the fuel gas flowing through the flame port of the burner 20. The thermocouple 26 also adjacent to the burner 20 is adapted to detect the flame and generates a detected voltage with respect to a detection period of time.

Figure 4:
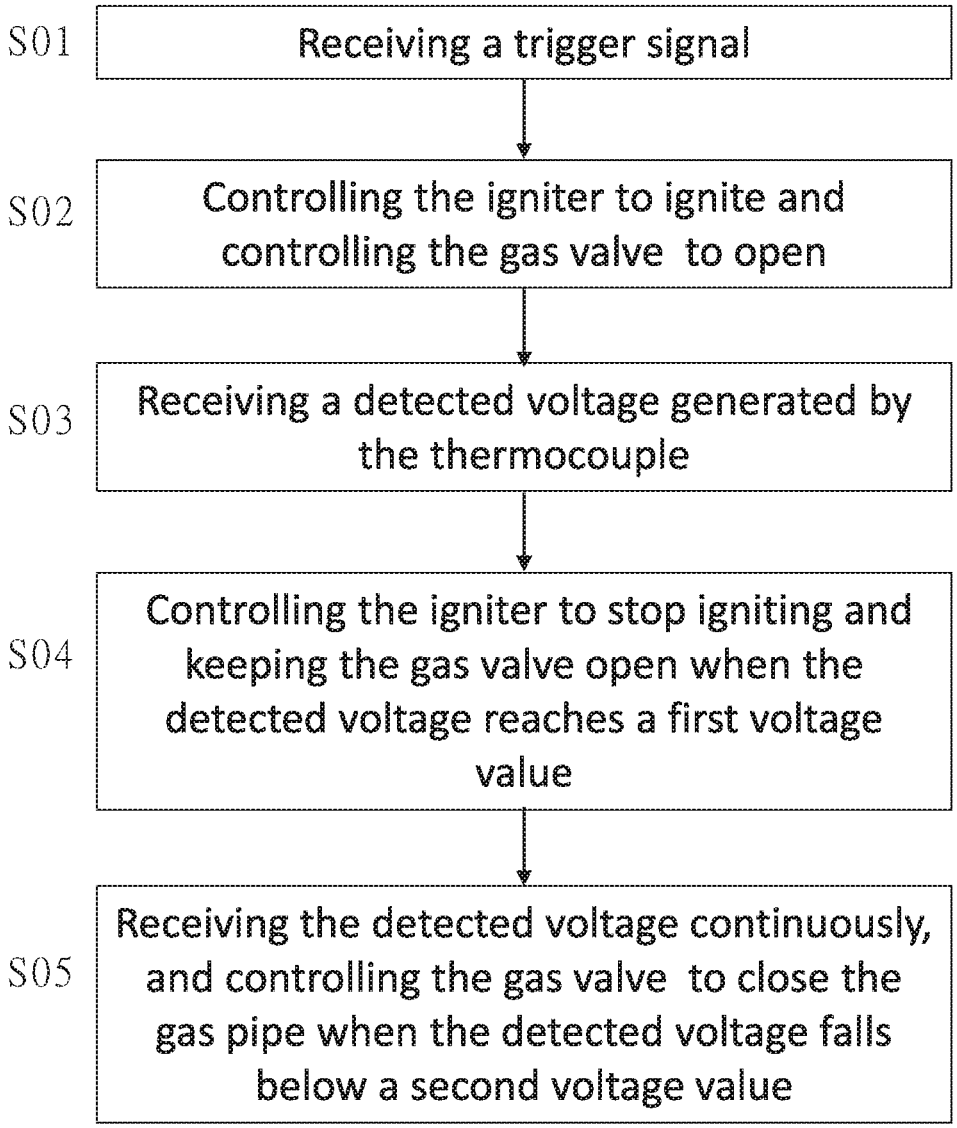
FIG. 4 is a flowchart showing the control method for the gas appliance according to the first embodiment of the present disclosure.

The control device 28 is electronically connected to the gas valve 22, the igniter 24, and the thermocouple 26. In addition, the control device 28 is also electronically connected to a trigger, for example, a switch 30. The switch 30 is triggered to generate a trigger signal which is then sent to the control device 28. The control device 28 includes an ignition circuit (not shown) for controlling the igniter 24. The control device 28 is adapted to execute a control method for the gas appliance 2 in the present embodiment. Referring to FIG. 4, the control method includes the following steps.

In step S01, receiving a trigger signal generated by the switch 30.

In step S02, controlling the igniter 24 to ignite and controlling the gas valve 22 to open the gas pipe P, which allows a fuel gas to enter the burner 20.

In step S03, receiving a detected voltage generated by the thermocouple 26 continuously.

Figure 5:
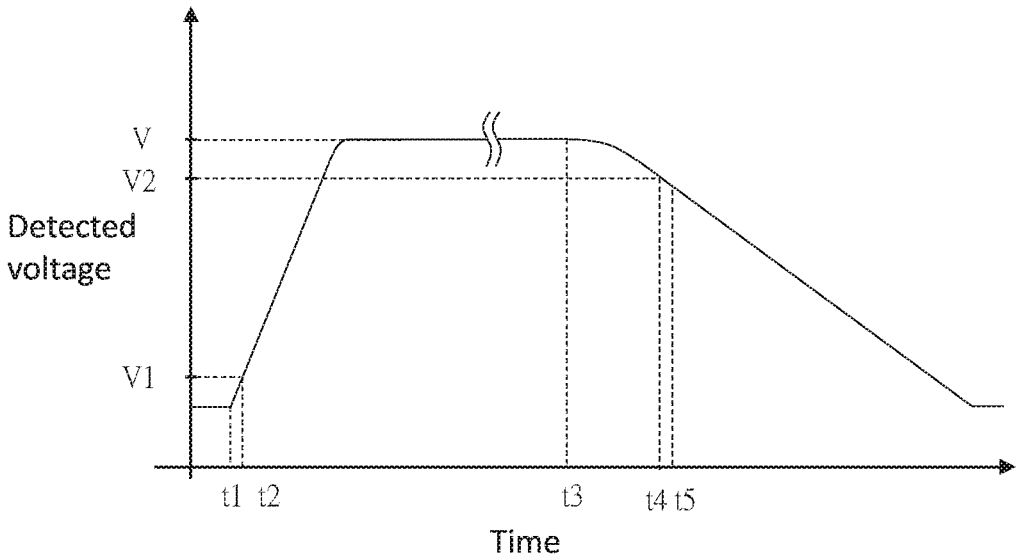
FIG. 5 is a curve diagram showing the detected voltage generated by the thermocouple with respect to the detection period of time according to the first embodiment of the present disclosure.

Referring to FIG. 5, after the fuel gas flowing through the flame port of the burner 20 is ignited (i.e., at the time t1), the detected voltage will increase gradually.

In step S04, controlling the igniter 24 to stop igniting and keeping the gas valve 22 open for the fuel gas to flow into the burner 20 through the gas pipe line P continuously when the detected voltage reaches a first voltage value V1 (i.e., at the time t2) which is defined as a successful ignition by the control device 28. In the other words, the successful ignition means that a flame is present. Thus, the thermocouple 26 will be continuously heated by the flame, which makes the detected voltage increase from the first voltage value V1 to a predetermined voltage value V. The predetermined voltage value V is determined by a flame size (that is, the predetermined voltage value V may be varied depending on the fuel gas flow entering the burner 20). In order to illustrate easily, in FIG. 5, a maximum detected voltage value is taken as the predetermined voltage value V. The maximum detected voltage value is generated when the gas appliance 2 is supplied with a maximum fuel gas flow.

In step S05, receiving the detected voltage generated by the thermocouple 26 continuously. If the flame is extinguished (i.e., at the time t3) due to an accident, for example, a wind or an insufficient fuel gas, but not due to closing the gas valve 22, the detected voltage generated by the thermocouple 26 will decrease gradually. When the detected voltage decreases from the predetermined voltage value V which is higher than a second voltage value V2 to lower than the second voltage value V2 (i.e., at the time t4), the control device 28 defines that the flame is extinguished and the step of controlling the gas valve 22 to close the gas pipe P is performed. The second voltage value V2 is higher than the first voltage value V1 and, for example, is twice the first voltage value V1.

With the aforementioned steps, compared with the conventional gas appliance 1, the gas appliance 2 of the present disclosure may detect the successful ignition more quickly so as to take less time for the igniter 24 to ignite continuously. Additionally, the gas valve 22 may be closed more quickly when the flame is extinguished accidentally, which prevents the fuel gas from leaking out of the flame port of the burner 20 too long.

Once the control device 28 receives the detected voltage below the second voltage value V2 even if which is temporary, the control device 28 still defines that the flame is extinguished and then controls the gas valve 22 to close the gas pipe P. For example, the flame does not contact with the thermocouple 26 briefly due to being blown by the wind, but soon contacts with the thermocouple 26 again, which means that the detected voltage generated by the thermocouple 26 may fall below the second voltage value V2 briefly and rise above the second voltage value V2 again. The aforementioned situation is defined to be a misjudging extinguishment. Thus, in order to avoid the misjudging extinguishment, in a second embodiment, the following step is further included. The control device 28 controls the gas valve 22 to close the gas pipe P when the detected voltage has been below the second voltage value V2 for a first predetermined period of time. As such, the gas pipe P may not be closed when the flame does not contact with the thermocouple 26 briefly. Preferably, the first predetermined period of time is within ten seconds, that is, as shown in FIG. 5, at the time t5 the control device 28 controlling the gas valve 22 to be closed. The difference between the time t4 and the time t5 is less or equals to ten seconds.

In a third embodiment, the following steps may be further included for controlling the gas appliance 2. The control device 28 is adapted to detect the fuel gas flowing in the burner 20 which is regulated by the gas valve 22 (e.g., the fuel gas flow is detected based on an opening degree of the gas valve 22 or is measured by an anemometer). When the fuel gas flow has reached a predetermined fuel gas flow for a second predetermined period of time (e.g., two to five minutes in the present embodiment), or when a slope derived from the detected voltage with respect to the detection period of time is decreased to a predetermined slope value (which means that the flame is in a stable temperature), at this time, the detected voltage is recorded as a recorded voltage value and then the first voltage value V1 for a next ignition procedure is renewed according to the recorded voltage value. The predetermined slope value is greater than or equals to zero. In the present embodiment, the recorded voltage value is divided by two or more to be set as the first voltage value V1 for the next ignition procedure. Preferably, the recorded voltage value is divided by any one of the values between three and four. Furthermore, preferably, the predetermined fuel gas flow is the maximum fuel gas flow through the gas valve 22 so the recorded voltage value may be equal to the predetermined voltage value V as shown in FIG. 5. If the thermocouple 26*a* is aging, oxidized, or contaminated, which results in receiving the detected voltage with an error value, through the manner described above the error value can be corrected.

Moreover, the second voltage value V2 in step S05 may be renewed based on the recorded voltage value as well. In the present embodiment, the second voltage value V2 is higher than half the recorded voltage value. Preferably, the second voltage value V2 is between two third and three fourth the recorded voltage value.

In practice, the recorded voltage value may be a maximum voltage value generated by the thermocouple 26 in a predetermined temperature, and the predetermined fuel gas flow may be any fuel gas flow that makes the flame produced by the burner has the predetermined temperature.

In addition, the control method according to each of the aforementioned embodiments may be applied for controlling a premixed gas appliance which has a blower to premix the air with the fuel gas and then the premix gas is supplied to the burner.

According to the illustration mentioned above, the successful ignition is defined through taking the recorded voltage value of the detected voltage generated by the thermocouple 26 as the first voltage value V1, which may speed up the ignition procedure, shorten the time of succeeding the ignition, and reduce the power consumption during the ignition procedure. The second voltage value V2 higher than the first voltage value V1 is used to define that the flame is extinguished for stopping the supply of the fuel gas more quickly so as to improve the safety of using the gas appliance 2.

A fourth embodiment of the control method is further described hereinafter. The fourth embodiment is based on the first embodiment, except that after step S05, i.e. after the control device 28 controls the gas valve 22 to close the gas pipe P, the following steps are further performed.

The control device 28 still receives the detected voltage generated by the thermocouple 26 continuously. When the control device 28 determines that the detected voltage is above the first voltage value V1, the control device 28 will enter a "prohibiting ignition state". In the "prohibiting ignition state", the control device 28 controls the igniter 24 not to ignite and keeps the gas valve 22 closed upon reception of the trigger signal from the switch 30.

The control device 28 will not exit the "prohibiting ignition state" until the control device 28 determines that the detected voltage is below the first voltage value V1. After exiting the "prohibiting ignition state", the control device 28 enters a "permitting ignition state". In the "permitting ignition state", the control device 28 controls the igniter 24 to ignite and controls the gas valve 22 to open the gas pipe P upon reception of the trigger signal from the switch 30.

The control method according to the fourth embodiment described above is used to assure that the ignition occurs only when the detected voltage generated by the thermocouple 26 is below the first voltage value V1.

A fifth embodiment of the control method is further provided hereinafter. The fifth embodiment is also based on the first embodiment, except that after step S05, i.e. after the control device 28 controls the gas valve 22 to close the gas pipe P, when the detected voltage is above the first voltage value V1, the following steps are further performed.

Figure 6:
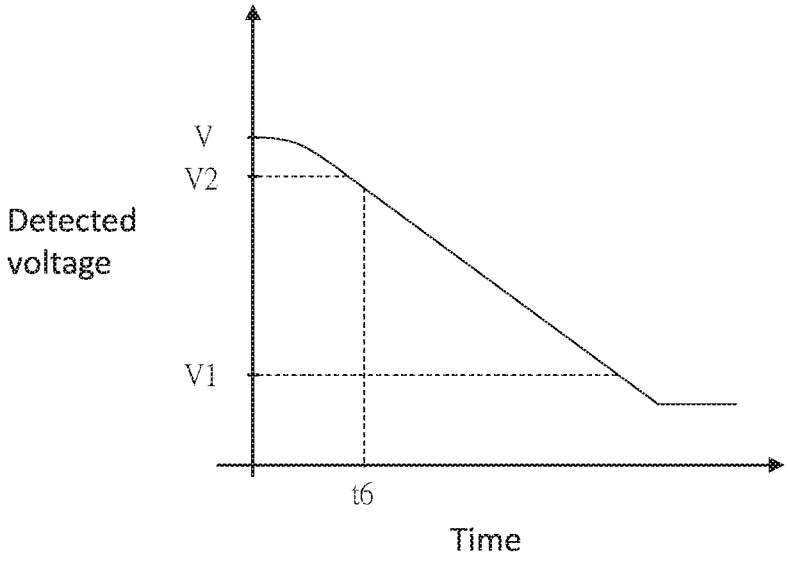
FIG. 6 is a curve diagram showing the detected voltage generated by the thermocouple with respect to the detection period of time according to a fifth embodiment of the present disclosure.
Figure 7:
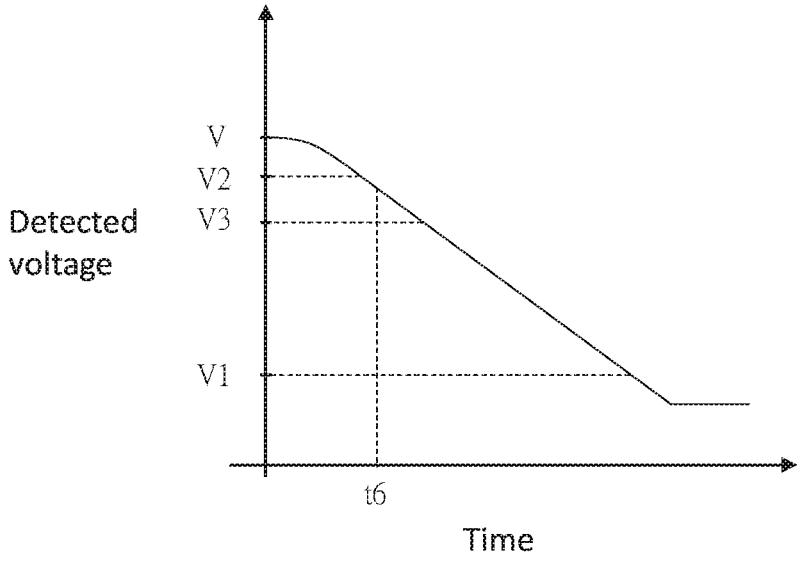
FIG. 7 is a curve diagram showing the detected voltage generated by the thermocouple with respect to the detection period of time according to a sixth embodiment of the present disclosure.

Referring to FIG. 6, a time t6 is taken as an exemplary timing that the control device 28 controls the gas valve 22 to close the gas pipe P but is not limited thereto. After the time t6, the control device 28 still receives the detected voltage generated by the thermocouple 26 and determines that whether the detected voltage has decreased for a third predetermined period of time (for example, 10 to 20 seconds), that is determining whether the slope derived from the detected voltage with respect to the third predetermined period of time is negative or not. If the detected voltage generated by the thermocouple 26 has decreased for the third predetermined period of time, it means that the gas valve 22 closes the gas pipe P normally. In such circumstance, the control device 28 enters a "permitting ignition state". In the "permitting ignition state", the control device 28 controls the igniter 24 to ignite and controls the gas valve 22 to open the gas pipe P upon reception of the trigger signal generated by the switch 30. Therefore, even when the gas valve 22 has closed the gas pipe P and the detected voltage is above the first voltage value V1, an ignition may be performed after the third predetermined period of time, thereby shortening the time from extinguishment of the flame to ignition of the flame.

If the detected voltage generated by the thermocouple 26 has not decreased for the third predetermined period of time, it means that the gas valve 22 does not close the gas pipe P normally and the burner 20 still produces the flame. In such circumstance, the control device 28 enters a "prohibiting ignition state". In the "prohibiting ignition state", the control device 28 controls the igniter 24 not to ignite and sends out a warning message upon reception of the triggering signal generated by the switch 30.

A sixth embodiment of the controlling method is described hereinafter. The sixth embodiment is based on the first embodiment, except that after step S05, i.e. after the control device 28 controls the gas valve 22 to close the gas pipe P, the following steps are further performed.

The control device 28 still receives the detected voltage from the thermocouple 26, and when the control device 28 determines that the detected voltage is above the third voltage value V3, the control device 28 will enter a "prohibiting ignition state". In the "prohibiting ignition state", the control device 28 controls the igniter 24 not to ignite and keeps the gas valve 22 closed upon reception of the triggering signal. The third voltage value V3 is between the first voltage value V1 and the second voltage value V2. Preferably, the difference between the third voltage value V3 and the second voltage value V2 is less than one third the difference between the first voltage value V1 and the second voltage value V2.

The control device 28 will not exit the "prohibiting ignition state" until the control device 28 determines that the detected voltage is below the third voltage value V3. After exiting the "prohibiting ignition state", the control device 28 enters a "permitting ignition state". In the "permitting ignition state", the control device 28 controls the igniter 24 to ignite and controls the gas valve 22 to open upon reception of the trigger signal generated by the switch 30.

By the control method according to the sixth embodiment described above, when the detected voltage generated by the thermocouple 26 is between the first voltage value V1 and the third voltage value V3, the ignition will be performed after the last extinguishment of the flame is performed, thereby shortening the time from extinguishment of the flame to ignition of the flame.

The control method according to the fourth embodiment to the sixth embodiment may be applied to the second and the third embodiment.

It must be pointed out that the embodiments described above are only some embodiments of the present disclosure. All equivalent structures and steps which employ the concepts disclosed in this specification and the appended claims should fall within the scope of the present disclosure.

What is claimed is:

1. A control method for a gas appliance, wherein the gas appliance includes a burner, a gas valve, an igniter, and a thermocouple; the burner includes at least one flame port; the gas valve is installed on a gas pipe communicating with the burner and is controlled to open or close the gas pipe; the igniter is adjacent to the at least one flame port of the burner and is controlled to ignite a fuel gas flowing out of the at least one flame port; and the thermocouple is adjacent to the burner, is adapted to detect a flame, and generates a detected voltage with respect to a detection period of time; comprising the following steps:

A. controlling the igniter to ignite and controlling the gas valve to open, wherein step A is performed upon reception of a triggering signal;

B. receiving the detected voltage generated by the thermocouple;

C. controlling the igniter to stop igniting and keeping the gas valve open when the detected voltage reaches a first voltage value;

D. receiving the detected voltage from the thermocouple continuously; and controlling the gas valve to close the gas pipe when the detected voltage above a second voltage value falls below the second voltage value, wherein the second voltage value is higher than the first voltage value; and after step D, when the detected voltage is above the first voltage value: controlling the igniter to ignite and controlling the gas valve to open the gas pipe upon reception of the triggering signal if the detected voltage has decreased for a predetermined period of time.

2. The control method of claim 1, wherein controlling the gas valve to close the gas pipe in step D is performed when the detected voltage has been below the second voltage value for a first predetermined period of time.

3. The control method of claim 2, wherein the first predetermined period of time is within ten seconds.

4. The control method of claim 1, further comprising the following step after step C: when a slope derived from the detected voltage with respect to the detection period of time decreases to a predetermined slope value, or when the fuel gas flowing into the burner has reached a predetermined fuel gas flow for a second predetermined period of time, recording the detected voltage as a recorded voltage value and then setting the first voltage value based on the recorded voltage value, wherein the predetermined slope value is more than or equals to zero.

5. The control method of claim 4, wherein the first voltage value is set to be less than half the recorded voltage value.

6. The control method of claim 5, wherein the first voltage value is set to be between one third the recorded voltage value and one fourth the recorded voltage value.

7. The control method of claim 1, further comprising the following step between steps C and D: recording the detected voltage as a recorded voltage value and then setting the first voltage value based on the recorded voltage value when a slope derived from the detected voltage with respect to the detection period of time decreases to a predetermined slope value, or the fuel gas flowing into the burner has reached a predetermined fuel gas flow for a second predetermined period of time; wherein in step D, the second voltage value is set based on the recorded voltage value; and the predetermined slope value is more than or equals to zero.

8. The control method of claim 7, wherein the second voltage value is set to be more than half the recorded voltage value.

9. The control method of claim 8, wherein the second voltage value is set to be between two third the recorded voltage value and three fourth the recorded voltage value.

10. The control method of claim 1, wherein the second voltage value is more than twice the first voltage value.

11. The control method of claim 1, further comprising the following step after step D: controlling the igniter not to ignite upon reception of the triggering signal if the detected voltage has not decreased continuously for the third predetermined period of time.

* * * * *